United States Patent [19]

Taggert

[11] Patent Number: 4,493,983

[45] Date of Patent: Jan. 15, 1985

[54] CURRENT DETECTOR IN COMBINATION WITH AN ELECTRICAL APPARATUS

[76] Inventor: Russell H. Taggert, 23 Orpinent Ave., Dersley Park, Springs, Transvaal, South Africa

[21] Appl. No.: 486,665

[22] Filed: Apr. 20, 1983

Related U.S. Application Data

[63] Continuation of Ser. No. 229,631, Jan. 29, 1981, abandoned.

[30] Foreign Application Priority Data

Feb. 1, 1980 [ZA] South Africa ..... 80/0596
Oct. 21, 1980 [ZA] South Africa ..... 80/6444

[51] Int. Cl.[3] ..... H05B 1/02
[52] U.S. Cl. ..... 219/494; 219/502; 219/508; 219/501; 236/46 R
[58] Field of Search ..... 219/494, 502, 329, 308, 219/309, 334, 492, 497, 493, 485, 507-510, 514, 519; 337/301-303; 307/269; 236/46 R

[56] References Cited

U.S. PATENT DOCUMENTS 2,266,252 12/1941 Osterheld ..... 219/334 X
4,238,672 12/1980 Siess ..... 219/502
4,245,148 1/1981 Gisske et al. ..... 219/492

*Primary Examiner*—M. H. Paschall
*Attorney, Agent, or Firm*—Cushman, Darby & Cushman

[57] ABSTRACT

A device for incorporation into the power supply circuit of an electrical apparatus comprising (a) a switch which is movable from one condition to another on application of power to the switch and which is held in the moved condition, as long as power is applied to the switch; (b) a signal emitter adapted to emit a power signal of short duration and being connected to the switch so that on emission of the power signal the switch will be moved to the other condition for the duration of the power signal; and (c) a current detector capable of detecting when a current flows in a line and being connected to the switch to supply power thereto when current flows in the line. The current detector may be a light emitting diode (L.E.D.) and a light detector arranged to transmit current to a relay switch coil which is electrically connected to the line by a current transformer.

12 Claims, 2 Drawing Figures

CURRENT DETECTOR IN COMBINATION WITH AN ELECTRICAL APPARATUS

Figure 1:
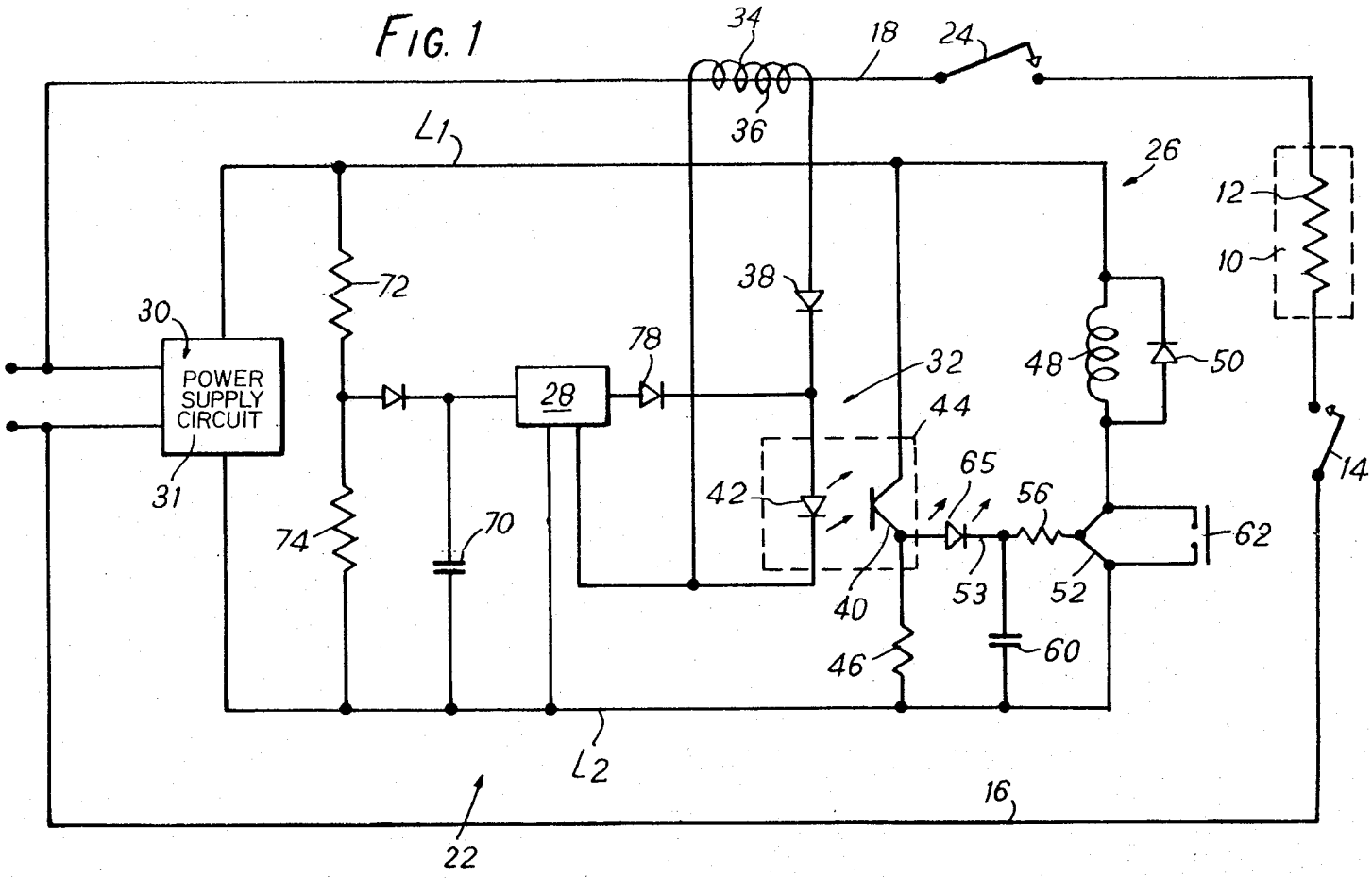

This is a continuation of application Ser. No. 229,631, filed Jan. 29, 1981, now abandoned.

This invention relates to devices for incorporation into the power supply circuit of an electrical apparatus to detect current flow therein.

According to one aspect of the invention there is provided a device for incorporation into the power supply circuit of an electrical apparatus comprising:

(a) a switch which is movable from one condition to another on application of power to switch moving means therein and being held in said other condition as long as power is applied to the switch moving means, (b) a signal emitter adapted to emit a power signal of short duration and being connected to the switch moving means so that on emission of the said power signal the switch will be moved to said other condition for the duration of the power signal, and (c) current detector means capable of detecting when a current flows in a line and being connected to the switch moving means to supply power thereto when current flows in the line.

Preferably the switch is located in the said line and when in the said other position permits current flow therethrough. The switch moving means is preferably a relay coil.

The current detector means preferably comprises a light emitting diode (L.E.D.) and a light detector arranged to transmit current to the relay switch coil which is electrically connected to the said line by a current transformer.

The electrical apparatus in which the device can be incorporated may be, inter alia, a domestic electric geyser.

Embodiments of the invention will now be described by way of example with reference to the accompanying drawings.

Figure 2:
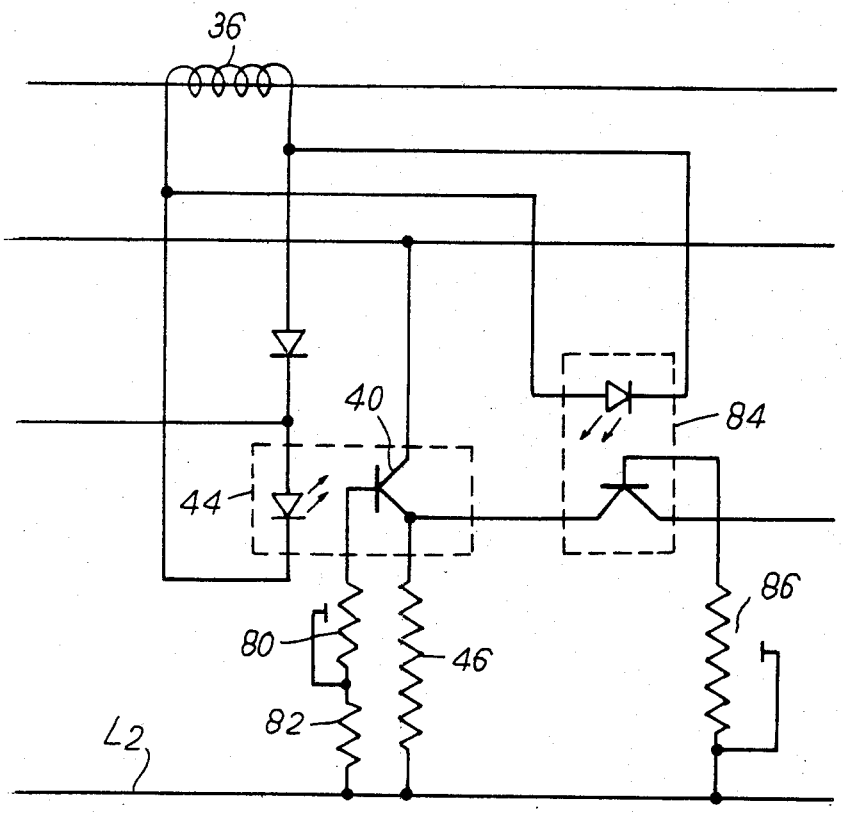

In the drawings:

FIG. 1 is a circuit diagram of an electric geyser incorporating a control device of the invention, and FIG. 2 shows a modification of the circuit.

Referring now to the drawings, there is shown a geyser 10 with a heating coil 12 and a thermostatically controlled switch 14 between one terminal of the coil 12 and the neutral line 16. The other terminal of the heating coil 12 is connected to the power line 18 through a conventional trip switch (not shown) at a domestic switch board.

A control device 22 is connected to the power line 18 between the trip switch and the geyser heating coil 12. This control device 22 incorporates a relay switch 24, a circuit 26 for the relay switch 24, a pulse emitter 28, a power supply circuit 30 and a detector circuit 32 for detecting when there is current flow along the power line 18.

The power supply circuit 30 includes a transformer 31, the primary coil of which is connected between the power line 18 and neutral 16 and the secondary is connected through a rectifying bridge (not shown) to supply power to circuit 26 for the relay switch 24. This circuit 30 provides a DC power supply preferably of 12 volts through lines $L_1$ and $L_2$.

The detector circuit 32 comprises a current transformer 34 providing a very large step-down in voltage through its secondary coil 36. The ends of this coil 36 are connected through a rectifying diode 38 to a light emitting diode 42. This diode 42 forms with a light detecting transistor 40, an optic isolator 44 which when it detects light from the LED 42 allows current to pass therethrough. The optic transistor 40 is connected via a biassing resistor 46 to the line $L_2$.

The relay coil circuit 26 comprises a relay switch coil 48 having a diode 50 connected across its terminals in conventional manner. One terminal of the coil 48 is connected to the positive line $L_1$ of the power circuit 30 and the other to one terminal of a transistor 52 the base of which is connected through a line 53 containing a resistor 56 and a light emitting diode 65 to the optic isolator 44 and resistor 46. A condensor 60 is provided between line $L_2$ and line 53 between the resistor 56 and the LED 65. A manual override switch 62 is provided in parallel with the transistor 52.

The LED 65 gives an indication when the relay coil circuit 26 is energised.

The pulse emitter 28 comprises a conventional programmable timer having a pulse output capable of being programmed to emit at least one pulse per time period but normally at least two per twenty four hour period. A battery 70 is provided to supply power to the pulse emitter 28 in the event of power failure or deliberate switching off of the geyser circuit for any reason so that the pulse emitter will retain its programme. A trickle charge circuit 72, 74 and 76 is provided to maintain the battery 70 charged. The pulse emitter 28 is connected to the base of the LED 42 through a diode 78.

The operation of the control device will now be described. For the purpose of this description it will be assumed that the geyser has just been filled with cold water. Because the temperature of the water is cold and hence below the temperature to which the water is to be heated (hereinafter referred as the "desired temperature"), the thermostat switch 14 will be closed. At this time however the relay switch 24 will be open. The pulse emitter 28 will be set to emit two pulses in a 24 hour period, conveniently in the early morning and late afternoon. When the pulse emitter 28 emits the first pulse the transistor 52 will be actuated to pass electricity therethrough so that the coil 48 will be energised pulling in the relay switch 24. Current will now flow in the line 18. This current flow will cause the LED 42 to become light emitting which will now be detected by the optic isolator 44 that in turn will permit power to flow therethrough biassing the transistor 52 into its passing condition so that the coil 48 remains energised.

When the water in the geyser 10 has been heated to the desired temperature, the thermostatically operated switch 14 will be opened. Consequently there will be no power flowing in the line 18. Thus the LED 42 will be de-activated, the detector 44 will not pass current and hence, too, the transistor 52 will not pass current so that the coil 48 will be de-energised and the relay switch 24 will be opened.

Should the pulse emitter 28 emit its next pulse when the thermostat 14 is still open, it will be seen that the coil 48 will be energised during the time of the pulse closing the relay switch 24. However as the thermostatically operable switch 14 will be open, the detector circuit 32 will not bias the relay switch circuit to hold the coil 48 energised and the relay switch 24 will immediately re-open.

Of course if the thermostatically operated switch 14 is closed when the next pulse is emitted via the pulse emitter 28 then operation will take place as described above.

By setting the pulse emitter 28 correctly the device 22 can be arranged so that there will always be an adequate supply of hot water without the geyser element 12 being operated unnecessarily. If however there are exceptional circumstances, because of e.g. unusual demand for hot water, the manually operable switch 62 can be closed. When this occurs the operation is the same as if a pulse had been supplied to the relay coil circuit 26.

Reference is now made to FIG. 2 in which is shown a modification to the connections to the optic LED 42. The base of the optic transistor 40 is connected to line $L_2$ through a potentiometer 80 and a negative temperature coefficient resistor probe 82 which is physically inserted in or on the geyser 10. When the temperature of the water in the geyser is above a pre-set amount, the resistance of resistor 82 drops to decrease the resistance between the base of the transistor 40 and line $L_2$ so that current will not pass through the transistor. Conversely, when the temperature of the water drops, the resistance of the resistor 82 rises so that current can pass through the transistor 40 thereby actuating the relay coil 48.

It will be seen that this arrangement replaces the need for the thermostatically controlled switch 14. It will further be seen that by adjusting the potentiometer 80, the cut-out temperature for the geyser can be easily adjusted and this can be effected at the control board. Furthermore, if desired, a digital read-out may be provided connected to the potentiometer so that there will be a convenient indication of the water temperature cut-out setting.

Further there is provided a second optic isolator 84 in series with isolator 44 and connected to the current transformer 34. A suitable adjustable biassing resistor 86 is applied to the base of isolator 44 so that this will not operate should the voltage of the mains supply drop. This will serve as a peak hour control device de-energising the circuit at periods of maximum demand on the mains.

The invention is not limited to the precise constructional details hereinbefore described and illustrated in the diagrams. For example one or both of the optic detectors may conveniently be embodied in an IC "chip". The probe cam may also have a positive temperature coefficient in which case the circuit will necessarily have to be modified. Many other modifications of the circuit to achieve the desired results will also be apparent to those skilled in the art.

Further the current detection and pulsing device may be used in other applications. For example it may be connected to a flip-flop circuit for conventional timer applications thereby e.g. avoiding the use of mechanical cams in such timers.

Further still, the detector circuit may comprise a pair of resistors in parallel connected to the power line 18, which resistors are in series with the light emitting diode.

I claim:

1. A device for incorporation into the power supply circuit of an electrical apparatus comprising:

a power supply line forming part of said circuit, a first switch which is in the power supply line and which may be open or closed depending upon extraneous conditions, a second switch which is in the power supply line in series with the said first switch and which is movable from an open first condition to a second closed condition on application of power to switch moving means therein and being held in said second condition as long as power is applied to the switch moving means, a signal emitter adapted to emit a power signal of short duration and being connected to the switch moving means so that on emission of the said power signal the switch will be moved to said second condition for the duration of the power signal, and current detector means comprising a coil that is in electromagnetic but not electrical connection with the said power supply line for detecting when a current flows in said power supply line and being connected to the switch moving means to supply power thereto when current flows in the line.

2. A device as claimed in claim 1 in which the switch is located in the said line and when in the said other position permits current flow therethrough.

3. A device as claimed in claim 1 wherein the switch moving means is a relay coil.

4. A device as claimed in claim 1 wherein the current detector means comprise a light emitting diode (L.E.D.) and a light detector arranged to transmit current to the relay switch coil.

5. A device as claimed in claim 4 wherein the L.E.D. is electrically connected to the said line by a current transformer.

6. A device as claimed in claim 1 wherein the signal emitter incorporates an electronic timing device.

7. A device as claimed in claim 1 wherein the electrical apparatus is a geyser having electrical heating means connected to a source of power through the said line.

8. A device as claimed in claim 1 wherein the said apparatus incorporates heat generating means, and wherein there is further provided a thermostat switch in the said line to detect the heat generated by said heat generating means which thermostat switch in one condition prevents current flow through the said line.

9. A device as claimed in claim 7 wherein the heat generating means is constituted by the said electrical heating means of the geyser and the thermostat switch detects the temperature of the water in the geyser.

10. A device as claimed in claim 9 wherein the thermostat switch incorporates (a) a probe, the resistance of which depends upon temperature, which is located within the geyser so as to be subject to the temperature of water therein, and which is arranged so that when the temperature detected is above a pre-set amount, the thermostat switch is opened, and (b) a potentiometer operatively connected the the probe to set the said pre-set amount.

11. A device as claimed in claim 10 wherein the potentiometer is located remote from the geyser.

12. A device as claimed in claim 1 comprising voltage detector means connected to detect the voltage in the said line and being connected to the said switch moving means so as to interupt power flow thereto when the voltage drops below a pre-set value.

* * * * *